US006336296B1

(12) United States Patent
Ishibashi et al.

(10) Patent No.: US 6,336,296 B1
(45) Date of Patent: Jan. 8, 2002

(54) SYSTEM FLOOR AND CONSTRUCTION METHOD THEREOF

(75) Inventors: Yutaka Ishibashi; Shigeru Fujimoto, both of Kanagawa-ken; Isako Tsushima, Tokyo; Yoshio Kojima; Junko Oikawa, both of Kanagawa-ken, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/472,810

(22) Filed: Dec. 28, 1999

(30) Foreign Application Priority Data

Dec. 28, 1998 (JP) ..... 10-373989
Dec. 28, 1998 (JP) ..... 10-373990

(51) Int. Cl.[7] ..... E04C 2/52

(52) U.S. Cl. ..... 52/220.2; 52/220.5; 52/220.8; 52/263; 52/167.1; 52/167.4

(58) Field of Search ..... 52/167.1, 167.7, 52/167.9, 167.4, 220.1, 220.3, 220.8, 403.1, 480, 263, 126.5, 126.6

(56) References Cited

U.S. PATENT DOCUMENTS 5,333,423 A * 8/1994 Propst ..... 52/126.6
5,630,300 A * 5/1997 Chen ..... 52/220.5
5,901,515 A * 5/1999 Chen ..... 52/263
5,904,015 A * 5/1999 Chen ..... 52/220.2
5,953,870 A * 9/1999 Jette ..... 52/220.1

* cited by examiner

*Primary Examiner*—Yvonne M. Horton
(74) *Attorney, Agent, or Firm*—Oblon, Spivak, McClelland, Maier & Neustadt, P.C.

(57) ABSTRACT

A floor system includes a plurality of panels placed on a base floor. A space is formed between the panels and the base floor for laying cables. A plurality of sliding plates are arranged on the base floor. A plurality of supports are provided and each support of the plurality of supports is arranged on each of the sliding plates so as to freely slide. The plurality of panels are supported by the plurality of supports by being fixed on a pedestal of the each support of the plurality of supports. The plurality of panels are hence connected to each other to form a single floor surface. The dynamic coefficient of friction between the bottom of the supports and the sliding plates is selected to be a value within a range of 0.09 to 0.25.

26 Claims, 12 Drawing Sheets

| FRICTION MEMBER | TEFLON TYPE FRICTION MEMBER | SLIDING PLATE | STAINLESS STEEL PLATE |
|---|---|---|---|
| TEST TIME | BEFORE VIBRATION TEST | | |
| LOADED MASS | SYSTEM FLOOR TEST BODY = 193.5 Kg | | |

DYNAMIC FRICTION FORCE SLIDE DISPLACEMENT POSITION
-20~20mm AVERAGE

| DIRECTION OF FORCE | DYNAMIC FRICTION FORCE | DYNAMIC FRICTION COEFFICIENT | DIRECTION OF FORCE | DYNAMIC FRICTION FORCE | DYNAMIC FRICTION COEFFICIENT |
|---|---|---|---|---|---|
| PLUS ① DIRECTION | 181.3 N | 0.095 | MINUS ① DIRECTION | 177.4 N | 0.094 |
| PLUS ② DIRECTION | 181.3N | 0.096 | MINUS ② DIRECTION | 182.3 N | 0.096 |
| PLUS ③ DIRECTION | 185.2N | 0.098 | MINUS ③ DIRECTION | 186.2 N | 0.098 |
| PLUS ④ DIRECTION | 187.2N | 0.099 | | | |

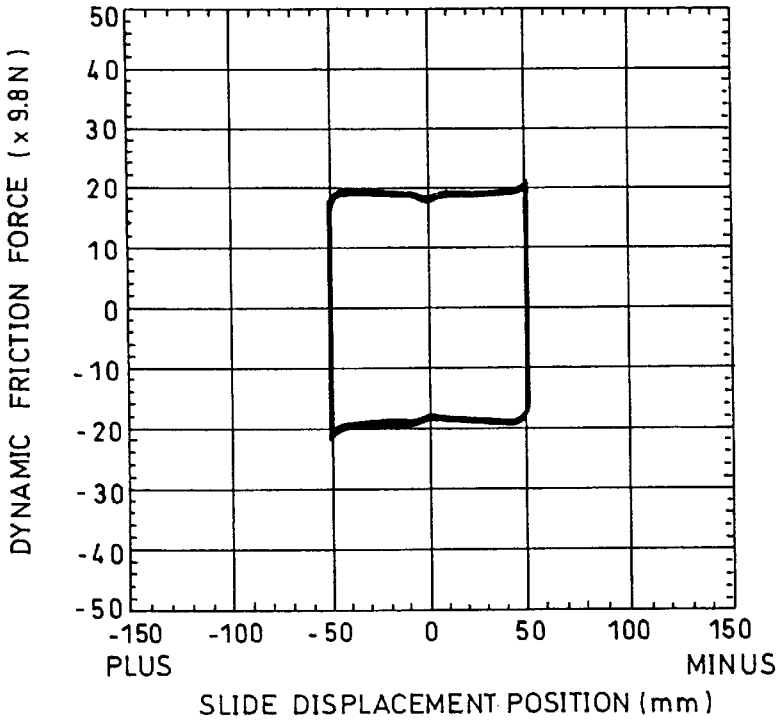

FIG. 6

| FRICTION MEMBER | BRASS | SLIDING PLATE | CROMIUM PLATED STEEL PLATE |
|---|---|---|---|
| LOADED MASS | SYSTEM FLOOR + WEIGHT = 60.3 Kg | | |

DYNAMIC FRICTION FORCE SLIDE DISPLACEMENT POSITION
-20~20mm AVERAGE

| DIRECTION OF FORCE | DYNAMIC FRICTION FORCE | DYNAMIC FRICTION COEFFICENT | DIRECTION OF FORCE | DYNAMIC FRICTION FORCE | DYNAMIC FRICTION COEFFICIENT |
|---|---|---|---|---|---|
| PLUS ① DIRECTION | 151.9 N | 0.257 | MINUS ① DIRECTION | 147.0 N | 0.249 |
| PLUS ② DIRECTION | 154.8 N | 0.262 | MINUS ② DIRECTION | 149.9 N | 0.254 |
| PLUS ③ DIRECTION | 157.8 N | 0.268 | MINUS ③ DIRECTION | 153.9 N | 0.260 |
| PLUS ④ DIRECTION | 163.7 N | 0.277 | | | |

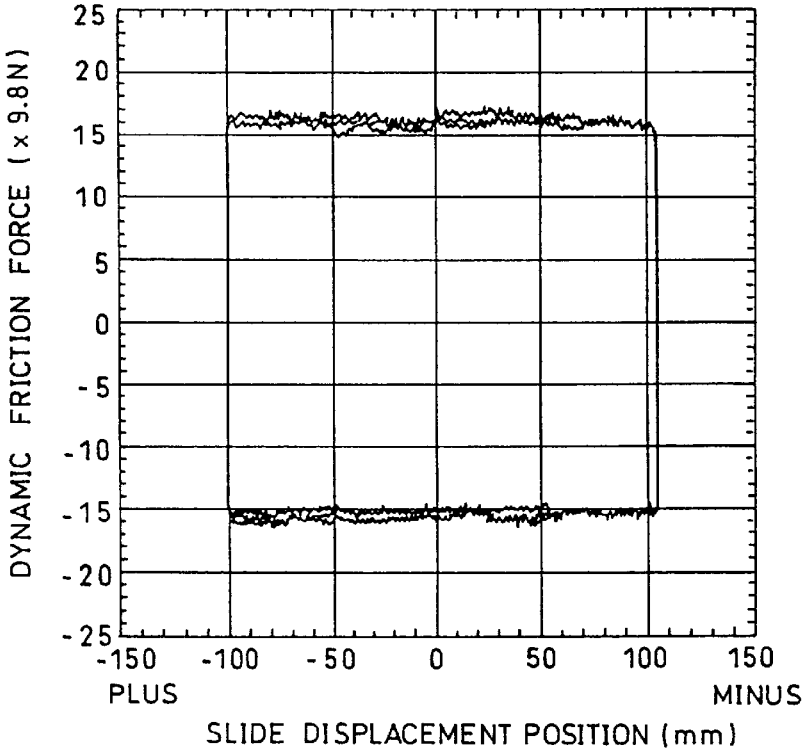

FIG. 7

| | |
|---|---|
| FRICTION MEMBER | TEFLON TYPE FRICTION MEMBER 1 |
| SLIDING PLATE | STAINLESS STEEL PLATE |
| LOADED MASS | SYSTEM FLOOR + TEST BODY = 158.3Kg |

| | |
|---|---|
| FRICTION MEMBER | BRASS |
| SLIDING PLATE | STAINLESS STEEL PLATE |
| LOADED MASS | SYSTEM FLOOR+TEST BODY = 158.3Kg |

SYSTEM FLOOR AND CONSTRUCTION METHOD THEREOF

CROSS-REFERENCE TO RELATED APPLICATIONS

This application is related and claims priority, under 35 U.S.C. §119, to Japanese Patent Application No. 10-373989 filed on Dec. 28, 1998 and Japanese Patent Application No. 10-373990 filed on Dec. 28, 1998, the entire contents of which two Japanese Patent Applications are hereby incorporated by reference herein.

BACKGROUND OF THE INVENTION

1. Field of the Invention

The present invention generally relates to a floor system built on a base floor so that cables, such as power cables or signal cables, can be laid in a space between a bottom of the floor surface of the floor system and the base floor, wherein the cables are connected to various electronic devices installed on the floor surface in an office and more particularly, to a structure of a floor system having a seismic isolation structure.

2. Discussion of Background

A floor system, used for a floor of an office where various electronic devices are installed, is constructed in such a manner that a plurality of floor panel units are supported by supports distributed on a base floor, and a space, formed between the bottom of the panel units and the top of the base floor, may house cables connected to the electronic device.

Such a floor system, as described immediately above, has low safety against an earthquake due to its structure. In fact, even during an earthquake having a medium magnitude on the Richter scale and wherein no buildings collapse, the floor system would most likely be extremely affected, and various office equipment, such as electronic devices, information devices, conmmunication devices, and office desks, all of which are usually installed on a floor system, would most likely be heavily damaged. Therefore, there are increasing requests for an anti-earthquake or seismic isolation design of a floor system itself in addition to the anti-earthquake design of a building.

SUMMARY OF THE INVENTION

Therefore, an object of the present invention is to provide a floor system, of a seismic isolation type, having a simple structure, and which can be produced and constructed at a low cost.

Another object of the present invention is to provide a floor system having a most suitable seismic isolation characteristic according to a building or a floor of the building.

Still another object of the present invention is to provide a floor system whose seismic isolation characteristic can be easily adjusted according to circumstances.

A further object of the present invention is to provide a floor system for easily replacing an existing floor system of a non-seismic isolation type with a floor system of a seismic isolation type.

To accomplish the above objects, the floor system, according to a first embodiment of the present invention, provides a space for laying cables between the bottom of the floor surface of the floor system and a base floor on which the floor system is built. The floor system includes: a sliding surface formed on at least a part of the base floor; a plurality of supports arranged on the sliding surface so as to freely slide; and a plurality of panels, which are mutually connected to each other having ends thereof fixed to the plurality of supports, and which form a floor surface with a space between the bottoms of the plurality of panels and the top of the base floor on which the floor system is built, wherein the floor system is characterized in that the coefficient of friction between the bottoms of the plurality of supports and the sliding surface is within the range from 0.09 to 0.25.

The floor system, according to the first embodiment of the present invention, is also characterized in that the sliding surface is composed of any one of the following: a non-ferrous metal, such as a stainless steel sheet or a hard plated steel sheet; a plastic coated plate wherein the coating includes polytetrafluoroethylene sold under the trademark "Teflon"; and a plastic plate including polytetrafluoroethylene.

The floor system, according to the first embodiment of the present invention, is also characterized in that the bottoms of the plurality of supports are composed of any one of a group consisting of plastic, brass, iron, or hard plated iron.

The floor system, according to the first embodiment of the present invention, is also characterized in that the bottoms of the plurality of supports are attached to a support leg, wherein the support leg has a surface in contact with the sliding surface, and the surface of the support leg is composed of any one of a group consisting of any one of plastic, brass, iron, or hard plated iron.

The floor system, according to the first embodiment of the present invention, is also characterized in that the hard plating, of both the hard plated steel sheet and the hard plated iron mentioned above, includes chromium.

The floor system, according to the first embodiment of the present invention, is also characterized in that the plastics are any one of a group consisting of plastics made entirely of polytetrafluoroethylene, plastics made of some polytetrafluoroethylene, plastics made of some oil and carbon, and plastics made of some of a solid lubricant.

The floor system, according to the first embodiment of the present invention, is also characterized in that the sliding surface has a sufficient area so that the plurality of supports can slide by a distance of at least ±10 cm or more.

The floor system, according to the first embodiment of the present invention, is also characterized in that at least a part of the cables (i.e., that part which is in contact with the sliding surface) is made of a member for reducing the frictional resistance, wherein the member is made of some of a material for reducing frictional resistance, such as polytetrafluoroethylene.

The floor system, according to the first embodiment of the present invention, is also characterized in that the cables, which are laid in the space between the bottom of the plurality of panels and the top of the base floor, have enough slack so that a sliding operation of the plurality of supports is not restricted.

The floor system, according to the first embodiment of the present invention, is also characterized in that the plurality of panels are made of approximately square plates having corners which are fixed to the plurality of supports.

A floor system, according to a second embodiment of the present invention, provides a space for laying cables between a bottom of a plurality of panels of the floor system and a top of a base floor on which the floor system is built. The floor system includes: a plurality of sliding plates arranged on the base floor; a plurality of supports arranged on the sliding plates so as to freely slide; and a plurality of panels, which are mutually connected to each other by having ends thereof fixed to the plurality of supports, and which forms a floor surface with a space between the bottoms of the plurality of panels and top of the base floor on which the floor system is built.

The floor system, according to the second embodiment of the present invention, is also characterized in that the sliding plates are composed of any one of a group consisting of: a non-ferrous metal, such as a stainless steel sheet or a hard plated steel sheet; a plastic coated plate having a coating made of some polytetrafluoroethylene sold under the trademark "Teflon"; and a plastic plate made of some polytetrafluoroethylene.

The floor system, according to the second embodiment of the present invention, is also characterized in that the bottoms of the plurality of supports are composed of any one of a group consisting of plastic, brass, iron, and hard plated iron.

The floor system, according to the second embodiment of the present invention, is also characterized in that the bottoms of the plurality of supports are attached to a support leg, wherein the support leg has a surface in contact with the sliding plates, and the surface of the support leg which is in contact with the sliding plates being composed of any one of a group consisting of plastics, brass, iron, and hard plated iron.

The floor system, according to the second embodiment of the present invention, is also characterized in that the hard plating, of both the hard plated steel sheet and the hard plated iron mentioned above, is composed chromium.

The floor system, according to the second embodiment of the present invention, is also characterized in that the plastic is any one of a group consisting of plastic made entirely of polytetrafluoroethylene, plastic composed of some polytetrafluoroethylene, plastic made of some oil and carbon, and plastic made of some solid lubricant.

The floor system, according to the second embodiment of the present invention, is also characterized in that each of the sliding plates has a sufficient area to allow the plurality of supports to slide a distance of at least ±10 cm or more.

The floor system, according to the second embodiment of the present invention, is also characterized in that at least a part of the cables (i.e., that part which is in contact with the sliding plates) is made of a member for reducing frictional resistance, wherein the member is composed of some of a material for reducing frictional resistance, such as polytetrafluoroethylene.

The floor system, according to the second embodiment of the present invention, is also characterized in that the cables, which are laid in the space between the plurality of panels and the base floor, have enough slack so that a sliding operation of the plurality of supports is not restricted.

The floor system, according to the second embodiment of the present invention, is also characterized in that either the sliding surface/plate) or the bottoms of the plurality of supports/support legs are made of any one of a group consisting of: a non-ferrous metal, such as a stainless steel sheet or a hard plated steel sheet; a plastic coated plate having a coating at least partially made of polytetrafluoroethylene sold under the trademark "Teflon"; and a plastic plate made of at least some polytetrafluoroethylene.

The floor system, according to the second embodiment of the present invention, is also characterized in that the plastic is any one of a group consisting of: plastic made entirely of polytetrafluoroethylene; plastic made of some polytetrafluoroethylene; plastic made of some oil and carbon; and plastic made of some solid lubricant.

A method for constructing a floor system, according to a third embodiment of the present invention, includes the steps of: forming a space for laying cables between bottoms of a plurality of panels of the floor system and a top of a base floor on which the floor system is built; forming a sliding surface on at least a part of the base floor; arranging a plurality of supports, each having pedestals and a bottom, on the sliding surface so that the bottom of each support is in contact with the sliding surface; and forming a floor surface by mutually connecting the plurality of panels to each other by having the ends thereof fixed to the pedestals of the each support of the plurality of supports, wherein the sliding surface and the bottoms of the plurality of supports are made of materials having a coefficient of friction within a range of from 0.09 to 0.25.

A method for constructing a floor system for forming a space, in which cables can be laid, between a bottom of a floor surface of the floor system and a top of a base floor on which the floor system is built, according to a fourth embodiment of the present invention, includes the steps of: arranging a plurality of sliding plates on the base floor; arranging a plurality of supports, each support of the plurality of supports having a pedestal and a bottom, on the sliding plates so that the bottom of each support is in contact with the sliding plates; and forming the floor surface by mutually connecting a plurality of panels to each other by having the ends thereof fixed to the pedestals of the plurality of supports.

A method for constructing a floor system for forming a space for laying cables between a bottom of the floor surface of the floor system and a top of a base floor on which the floor system is built, wherein the floor system is built on different floors of a building, according to a fifth embodiment of the present invention, and includes the steps of: forming a sliding surface on at least a part of the base floor of each floor; arranging a plurality of supports, wherein each support of the plurality of supports has a pedestal and a bottom on the sliding surface, so that each support of the plurality of supports is arranged in a manner that the bottom of each support is in contact with the sliding surface; and forming a floor surface by mutually connecting a plurality of panels to each other by fixing the ends thereof to the pedestal of each support of the plurality of supports, and wherein the sliding plates and bottoms of the plurality of supports are made of materials having a coefficient of friction which is within the range from 0.09 to 0.25, and wherein the coefficient of friction on a lower floor is selected to be smaller than the coefficient of friction on a higher floor.

BRIEF DESCRIPTION OF THE DRAWINGS

FIG. 6 is a graph and tables showing the results of the static load test under a friction condition for the floor system according to the present invention.

FIG. 7 is also a graph and tables showing the results of the static load test under a maximum friction condition for the floor system according to the present invention.

DETAILED DESCRIPTION OF THE PREFERRED EMBODIMENTS

The embodiments of the present invention will be explained hereunder with reference to the accompanying drawings.

Figure 1:
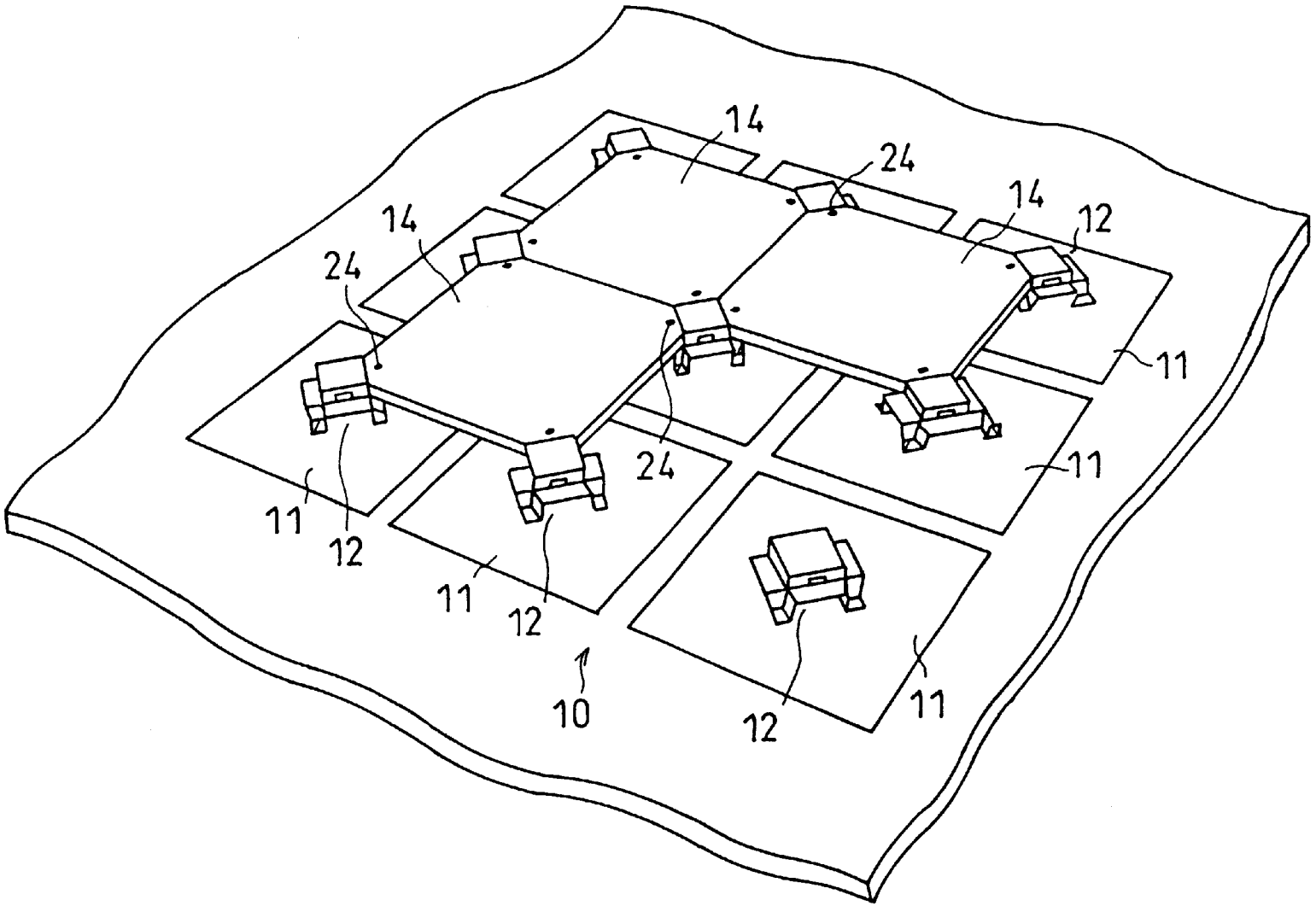
FIG. 1 is a perspective view showing a part of a floor system according to an embodiment of the present invention.

FIG. 1 is a perspective view showing a part of a floor system according to an embodiment of the present invention. In FIG. 1, approximately square sliding plates 11, preferably made of stainless steel, are arranged at equal intervals and fixed to the base floor 10 of a building by a mechanical fixing method, such as an adhesive or bolts. The sliding plates 11 may be made of various materials such that the sliding plates 11 may be a stainless steel sheet, a chromium or other rigid metal plated steel sheet, a plastic coated sheet, wherein the plastic of the coating includes some polytetrafluoroethylene (sold under the trademark "Teflon"), or a plastic sheet including some polytetrafluoroethylene. Surfaces of the sliding plates 11 are ground and made smooth to reduce the coefficient of friction with respect to support legs, which will be described later.

Each of the supports 12 are mounted approximately at the center of each sliding plate 11 one by one so as to freely slide. Each of the supports 12 has a pedestal 20 formed at each of the four sides of the support 12 on the top portion of the support 12. A plurality of approximately square panels 14 are supported by a plurality of supports 12. In other words, corners of each of four panels 14 are mounted on the pedestal 20 of one of the supports 12 with each corner of a panel 14 being cut off or chamfered (i.e., a triangle cut off of the square or ninety-degree corner). The supports 12 are made of a light and rigid material, such as aluminum die casting, zinc aluminum alloy, or plastic.

The panels 14 are laid over the top of the base floor so as to form an entire floor surface. Under the entirety of the floor surface formed by the panels 14, a space is provided between the bottom surface of the plurality of panels 14 and the top of the base floor and bounded on the sides by the walls, pillars or a fixed floor provided along the walls of the room. In this manner, the entirety of the floor system is allowed to slide horizontally.

The panels 14 are approximately square having a size, for example, of 500 mm×500 mm. However, a rectangular panel of 500 mm×1000 mm formed by joining two square panels may also be used. In the case of rectangular panels, a triangular notch may be formed at the middle of each long side of the rectangular panel for engaging the edge of the panel to the pedestal 20 of the support 12.

On the other hand, the sliding plates 11 are approximately square having a size, for example, of 400 mm×400 mm. In consideration of the anti-earthquake structure of a general building, the size of the sliding plates 11 is determined so as to allow the sliding displacement of the supports 12 to be at least ±10 cm. As the area of the sliding plates 11 becomes smaller, the cost will be reduced. However, needless to say, sliding plates 11 having an area larger than that shown above may be used. Accordingly, the maximum area of the sliding plates 11 is reached when gaps between the adjacent sliding plates 11 become zero thus, forming a sheet of sliding plate covering the entirety of the base floor 10. In this case, an increase in the cost of the sliding plate 11 may become a concern. However, by grinding the surface of the base floor 10 to form a sliding surface, the sliding plate 11 may be omitted.

Figure 2:
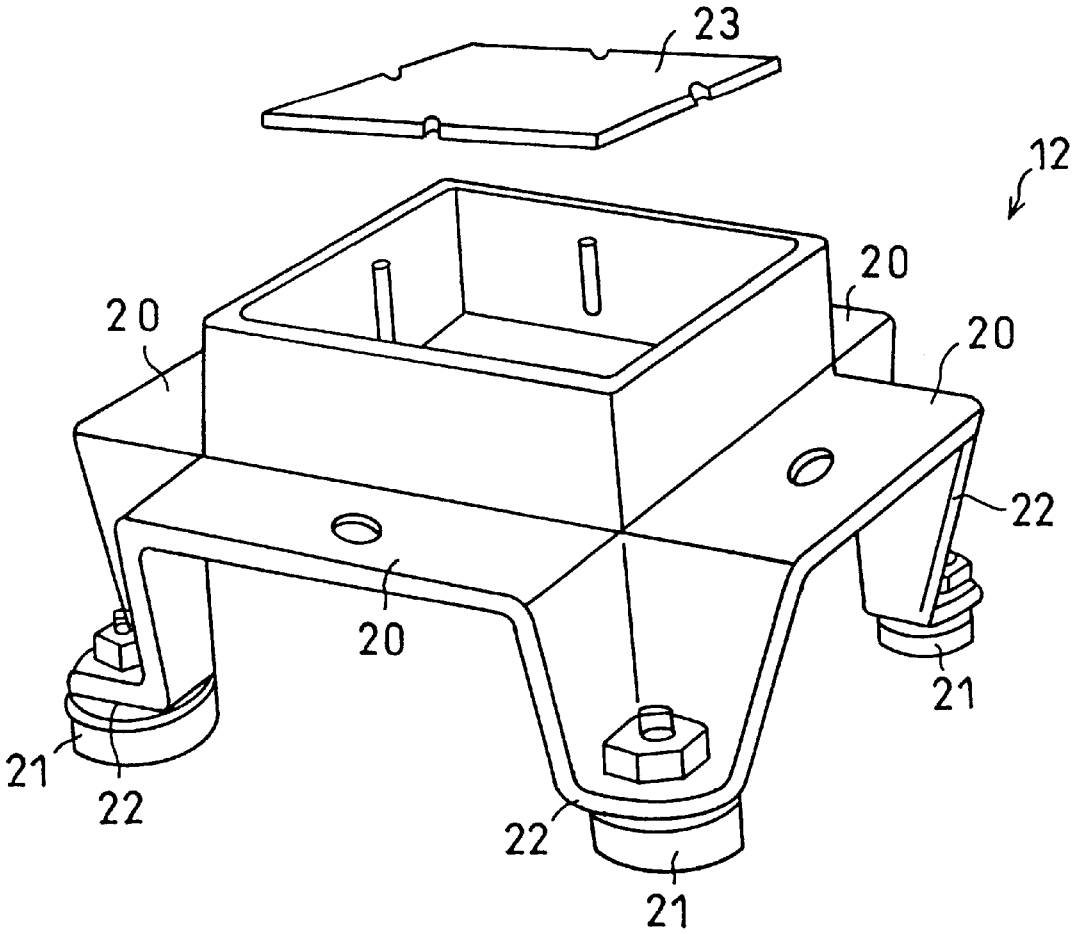
FIG. 2 is an enlarged view of a support shown in FIG. 1.

FIG. 2 is an enlarged view of the support 12 shown in FIG. 1. A pedestal 20 is formed on the support 12 at approximately the four outer sides of a square frame 19 on which the corners of the panels 14 are placed in order to be fixed thereto. The four corners of the pedestal 20 extend downwardly and horizontal bottoms 22 are formed at the lower ends. Support legs 21 are attached to the bottoms 22 of the supports 12, preferably using nuts and bolts. A cover 23 is provided on the opening of the frame 19 and the top of the cover 23 is located in approximately the same plane as the plane containing the upper surfaces of the panels 14 placed on the pedestal 20. In place of the cover 23 on the opening of the frame 19, plug sockets or cable-drawn parts, used for laying cables in offices, may be fit and installed. The portion in which the plug sockets and cable-drawn parts are provided is not limited to the opening of the frame 19. They may be provided at notches formed at a periphery of each of the panels 14.

The four corners of each panel 14 are cut off or chamfered (i.e., a triangular shape cut off of the square or ninety-degree corner) as shown in FIG. 1. The edges, being chamfered or having a triangular shape cut off, are placed on the pedestal 20 and fixed by bolts 24 thereto. Therefore, the plurality of panels 14 are connected to each other by the support 12 so that the connected panels 14 together move horizontally along the base floor 10. However, different structures and methods for fixing the panels 14, from those described above, may be applied. Since the panels 14 are connected to each other by the supports 12 as described above, the entirety of the floor system slides together as a unit. The panels 14 are fixed to the pedestals 20 of the supports 12 so that the panels 14 may move to a certain extent in the vertical direction, but the panels 14 may also be rigidly fixed so as to restrict any movement in the horizontal direction. With the above-described structure, a level and uniform load may be kept on the surface of the floor system.

In operation, the above-described structure allows all of the panels 14, mounted on the pedestal 20 of the supports 12, to be connected to each other by the supports 12 at the four corners of the panels 14. In this manner, a space is formed between the plurality of panels 14 and the base floor 10. Cables, such as power cables and signal cables, can be laid in the space between the bottom of the plurality of panels 14 and the top of the base floor 10.

Figure 14:
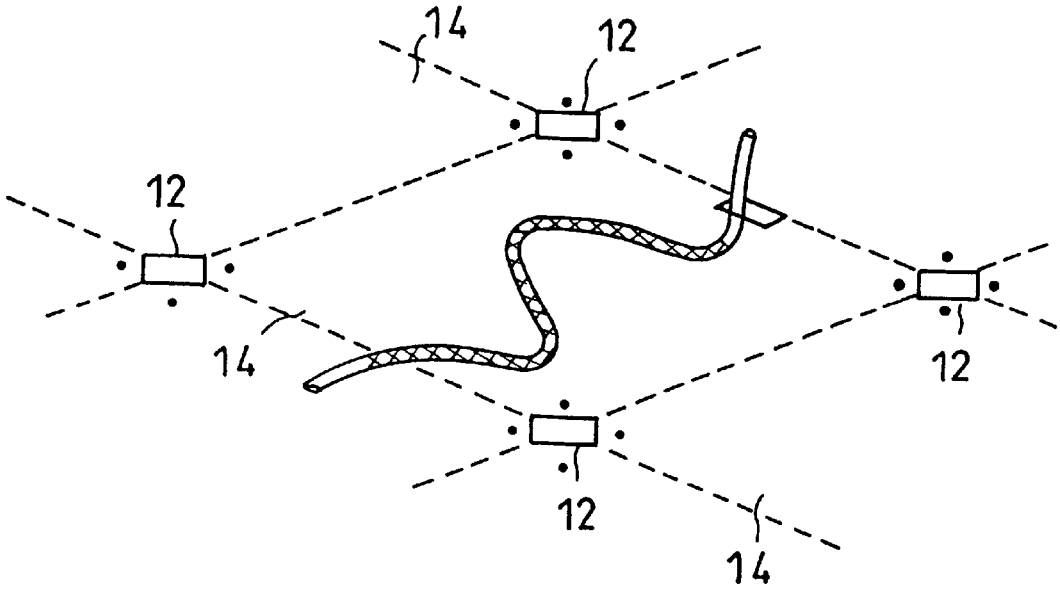
FIG. 14 is a schematic perspective view showing a cable laid in the floor system according to the present invention.

At least a portion of the cables, which are laid in the space between the plurality of panels 14 and the base floor 10, may be in contact with the sliding plate 11. It is preferable if the portion of the cable, that is in contact with the sliding plate 11, be made of a material having a small coefficient of friction. Alternatively, a substance having a small coefficient of friction, for example, a polytetrafluoroethylene sheet or tape, may be wound around the cable, as shown in FIG. 14. Thus, the sliding effect of the cables is improved.

Particularly, when the entire floor system slides during an earthquake, it is desirable that movement of the floor system not be restricted or obstructed by friction of cables laid in the space between the bottom of the plurality of panels of the floor system and the top of the base floor. To prevent the restriction or obstruction of movement of the floor system due to cables laid in the space between the plurality of panels of the floor system and the base floor, it is necessary to give the cables some slack and thus, allow the floor system to be able to achieve a maximum sliding displacement.

Figure 3:
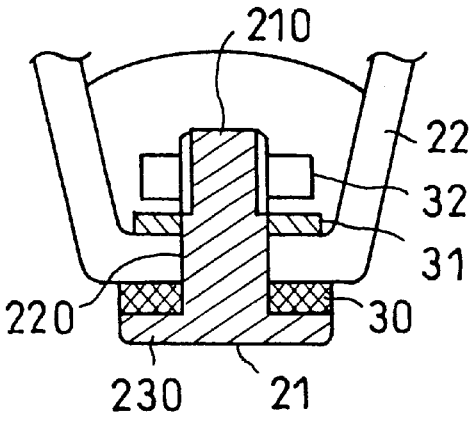
FIG. 3 is a partial cross-sectional view showing a structure of a support leg attached to a bottom of the support shown in FIGS. 1 and 2.
Figure 4:
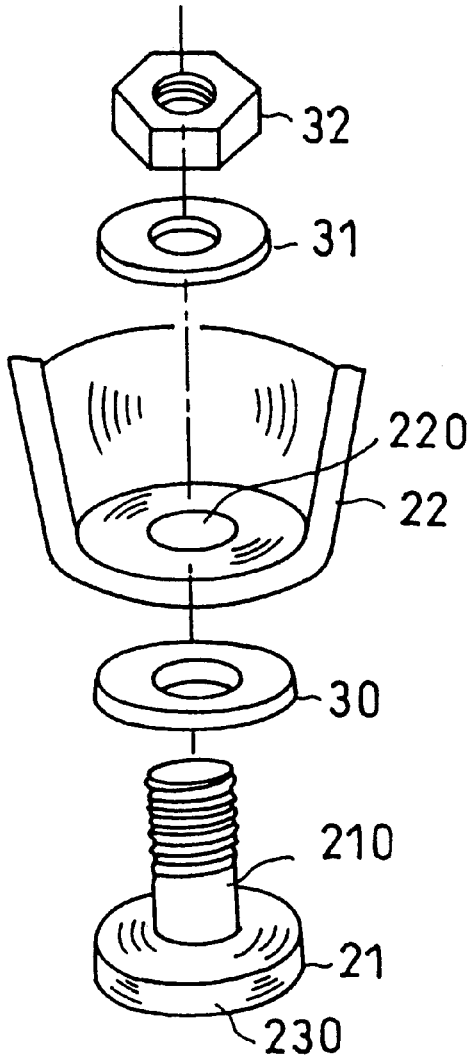
FIG. 4 is an exploded perspective view of the structure of the support leg attached to the bottom of the support shown in FIG. 3.

FIG. 3 is a partial cross-sectional view showing a structure for attaching the support leg 21, shown in FIG. 2, to the bottom 22 of the support 12. FIG. 4 shows the same structure as that in FIG. 3, but with the parts disassembled.

A hole 220 is bored at the center of the bottom 22 of each support 12 and a shaft 210, of the support leg 21, is inserted into the hole 220. The support leg 21 has a disk 230, with a diameter of about 30 mm and a thickness of about 12 mm, at the lower end of the shaft 210. At the bottom of the disk 230, a sliding surface is formed. The sliding surface, at the bottom of the disk 230, is in contact with the sliding plate 11, shown in FIG. 1, and the sliding surface slides freely on the sliding plate 11. An elastic rubber pad 30 is inserted between the top of the disk 230 of the support leg 21 and the bottoms 22 of the supports 12. The rubber pad 30 makes a load of each of the supports 12 uniform and provides a cushion effect for preventing a vertical movement of the panels 14. The rubber pad 30 is required to be somewhat soft and therefore, the rubber pad 30 may be made of a material, such as a natural rubber, a synthetic rubber, a urethane rubber, or a silicone rubber.

The upper end of the shaft 210 of the support leg 21 has male threads thereon which mate with female threads on the inner surface of a nut 32 in order to tightly fix the rubber pad 30 to the bottom 22 of the support 12. A ring 31 is interposed between the bottom 22 of the support 12 and the nut 32. However, the means for fixing the rubber pad 30 to the bottom 22 of the support 12 is not limited to being a screw and nut 32, and any fixing means may be used, as long as it is not easily disengageable. It is desirable that the a fixing means restricts movement in the horizontal direction, but allows a slight movement in the vertical direction as is the case with the panels 14.

It is desirable that the material of the support legs 21 be one of a group consisting of brass, iron, or hard plated (for example, chromium plated) iron. In the case where the support legs 21 are made of brass, iron, or hard plated iron, if the periphery of each surface, which is in contact with the sliding plate 11, is inclined (i.e., chamfered) or curved, smoother sliding can be achieved. Since the support leg 21 can be easily mounted and dismounted from the bottom 22 of the support 12, the coefficient of friction with respect to the sliding plate 11 can be adjusted easily by replacing the support leg 21 with a different material.

Figure 5:
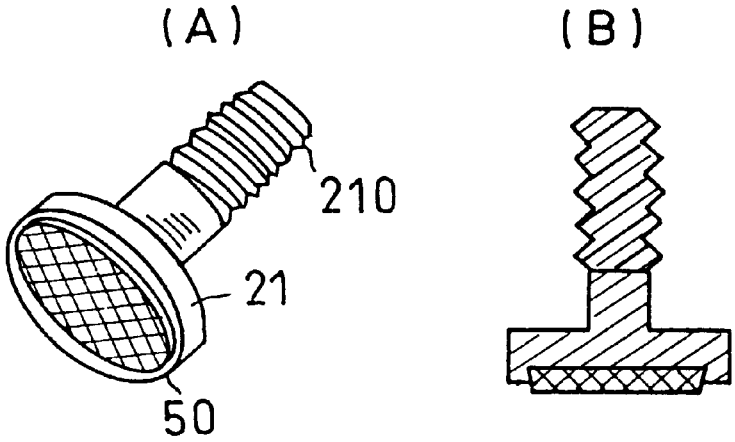
FIG. 5 is a perspective view showing another embodiment of the support leg used in the floor system according to the present invention.

FIG. 5 shows another embodiment of the support leg 21. The support leg 21 is made of a material, such as plastics, iron, or hard plated iron. A friction member 50 is affixed to the bottom of the disk 230. The friction member 50 is preferably made of any one of the following: polytetrafluoroethylene; a plastic being made of some polytetrafluoroethylene; a plastic being made of some oil and carbon; or a plastic being made of some solid lubricant. By simply affixing the friction member 50 to the bottom of the support leg 21, the coefficient of friction with respect to the sliding plate 11 can be adjusted easily at a low cost. Therefore, it is easy to replace an existing floor with a seismic isolation floor system at a low cost by using the support leg according to the embodiment.

Slightly inclining (i.e. chamfering) or curving the periphery of the surface of the friction member 50 (i.e., the surface which is in contact with the sliding plate 11) can achieve the effect of smoother sliding.

When an earthquake occurs and a building provided with the floor system according to the present invention vibrates horizontally, the supports 12 for panels 14 slide horizontally on the sliding plates 11 and hence the entire floor system moves back and forth horizontally. Therefore, the horizontal vibration of the floor system caused by the earthquake is absorbed and relieved and equipment, such as various electronic devices and desks on the floor system, can be prevented from falling down and being damaged.

Meanwhile, it is important that the floor system slides within a proper range to fully utilize such seismic isolation ability. Namely, if the sliding range is too small, the equipment on the floor system collapses or collides with each other, resulting in damage since the floor system does not slide sufficiently in the horizontal direction and hence the horizontal vibration due to an earthquake is not absorbed sufficiently. On the contrary, if the sliding range is too large, the horizontal movement of the floor system increases and collides with the wall of the room, and thus the equipment on the floor collides with each other and is damaged.

As the sliding range of the floor system depends on the dynamic coefficient of friction between the sliding plates 11 and the contact bottoms 22 of the supports 12, it is important to select the dynamic coefficient of friction having a proper value. The inventors of the present invention have conducted various experiments, which will be described later, using a model of the floor system and found as a result that the dynamic coefficient of friction between the sliding plates 11 and the contact bottoms 22 of the supports 12 (in the case of FIG. 4, the dynamic coefficient of friction between the sliding plates 11 and the contact bottoms 22 of the sliding support legs 21 and in the case of FIG. 5, the dynamic coefficient of friction between the sliding plates 11 and the friction member 50 affixed to the bottoms of the sliding support legs 21) is most effective for the floor system according to the present invention when it is within the range of from 0.09 to 0.25.

The tests conducted for selecting of the dynamic coefficient of friction will be explained hereunder. Firstly, a model of the floor system shown in FIG. 1 is constructed using four square panels 14 with a side length of 500 mm, four square sliding plates 11 with a side length of 400 mm, and nine supports 12. The static load test is conducted using the model. In the static load test, force in the positive and negative directions is applied to the floor section of the model in one direction by the hydraulic actuator so as to generate a reciprocating sliding movement and the dynamic coefficient of friction, between the bottoms 22 of the supports 12 and the sliding plates 11 during the sliding movement, is measured. The force in the positive direction and negative direction is applied to the floor section repeatedly four times and sliding, within the range of ±50 mm, is generated. The moving speed of the panels 14 at this time is selected to be 0.5 mm/s.

FIG. 6 shows a table and a graph indicating the results of the test. For the test, a polytetrafluoroethylene friction member is used for the bottoms 22 of the supports 12 and a stainless steel sheet is used as the sliding plates 11. A test body, having a long side of 560 mm, a short side of 450 mm, and a height of 1200 mm, is put on the floor, and a load of 193.5 kg, including the weight of the four panels 14, is applied to the nine supports 12. The sliding movement is generated in a direction parallel with the short side of the metal case.

The mean values of dynamic friction force and dynamic coefficients of friction, measured within the range of ±10 cm of the sliding displacement, are indicated in the table as the results of measurement. A curve indicates the relationship between the dynamic friction force and the sliding displacement at this time. In the table, $\hat{1}$ to $\hat{4}$ are shown to indicate the loading count in the positive direction or negative direction. For example, positive direction $\hat{1}$ means the first loading in the positive direction. The static load test showed that the dynamic coefficient of friction of the aforementioned floor system model is about 0.09.

FIG. 7 shows a table and a graph indicating the results of the static load test similar to the test shown in FIG. 6, except having some different test conditions. Namely, in FIG. 7, brass is used for the friction member 50 at the bottoms 22 of the support legs 21. Chromium plated steel sheets are used for the sliding plates 11 and a weight load is put on the floor with a total load being 60.3 kg. The test showed that the dynamic coefficient of friction under the above conditions is 0.25. The dynamic coefficient of friction obtained here is almost equal to that with the metal case put on the floor system.

Figure 8:
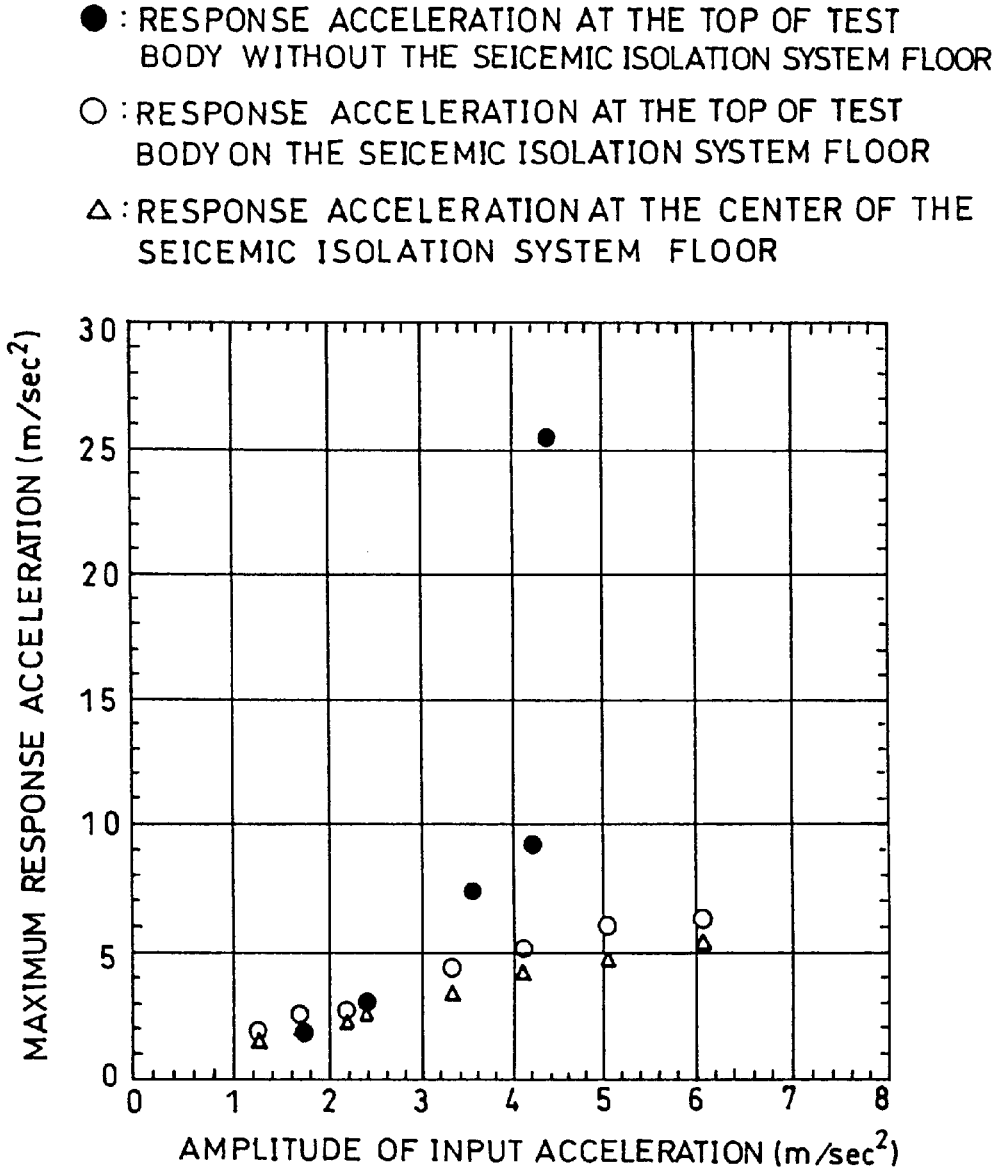
FIG. 8 is a graph and table showing the results of the vibration test under a maximum friction condition for the floor system according to the present invention.

FIG. 8 shows a table and a graph indicating the results of the vibration test for measuring the seismic isolation characteristic of the floor system model according to the present invention shown in FIG. 6. In this test, the floor system model of the present invention is fixed to the exciting device including the base floor therefore (10 shown in FIG. 1) and the maximum response acceleration of a specific part on the floor at the time of vibration for 20 cycles of sinusoidal wave by the exciting device is measured. In FIG. 8, the horizontal axis indicates the input maximum acceleration and the vertical axis indicates the response acceleration of a specific part on the floor. A line formed by connecting the black circular outlines (i.e., ○) plotted on the graph indicate the response acceleration at the top of the metal case and a line formed by connecting black triangular outlines (i.e., Δ) plotted on the graph indicate the response acceleration at the center of the floor surface. A line formed by connecting the solid black circles (i.e., ●) plotted on the graph indicate a response acceleration at the top of the test body when, as a comparison example, an ordinary floor system to which the present invention is not applied, that is, a non-seismic isolation floor system, is used.

Figure 9:
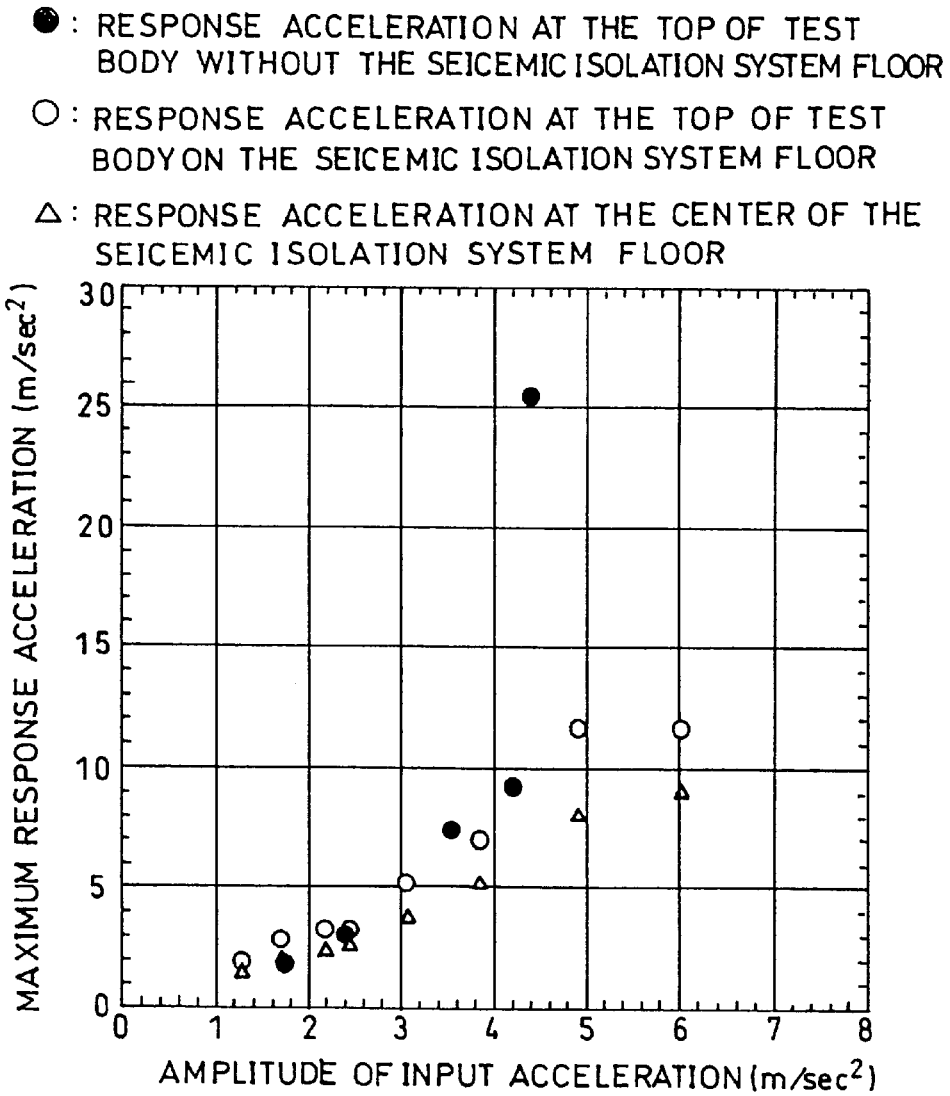
FIG. 9 is also a graph and table showing the results of the vibration test under a maximum friction condition for the floor system according to the present invention.

FIG. 9 shows a table and a graph indicating the measured results of the seismic isolation characteristic of the floor system according to the present invention shown in FIG. 7 in the same vibration test.

As FIGS. 8 and 9 show, in the case of a floor system of a non-seismic isolation structure, it is ascertained that when the input acceleration exceeds about 4 $m/s^2$, sudden response acceleration is indicated and the frame, installed on the floor system, fell down. On the other hand, in the case of the floor system of the seismic isolation structure, even if the input acceleration exceeds 4 $m/s^2$, the response acceleration is not amplified greatly and is kept at almost constant response acceleration and the seismic isolation effect thereof is clear.

Furthermore, the inventors have ascertained, with a simulation using the earthquake response analysis method, that the dynamic coefficient of friction of the floor system, according to the present invention, within the range of from 0.09 to 0.25, is a most effective value. In this simulation, an analytical model was used in combination of a seven-storied building model and a floor system model of the present invention installed on each floor of the building. Applying great earthquake waveforms actually measured in the past at various places in the world to this analytical model, the earthquake response analysis is carried out. In this case, as a dynamic coefficient of friction of the floor system according to the present invention, 0.05, 0.1, 0.15, 0.2, and 0.25 are selected and the analysis is carried out using them as parameters. As an earthquake waveform, the acceleration waveforms of the El Centro earthquake and Taft earthquake, which occurred in the United States of America, and the Tokachi-Oki earthquake and Hyogo-ken Nambu earthquake, which occurred in Japan, are used.

Figure 10:
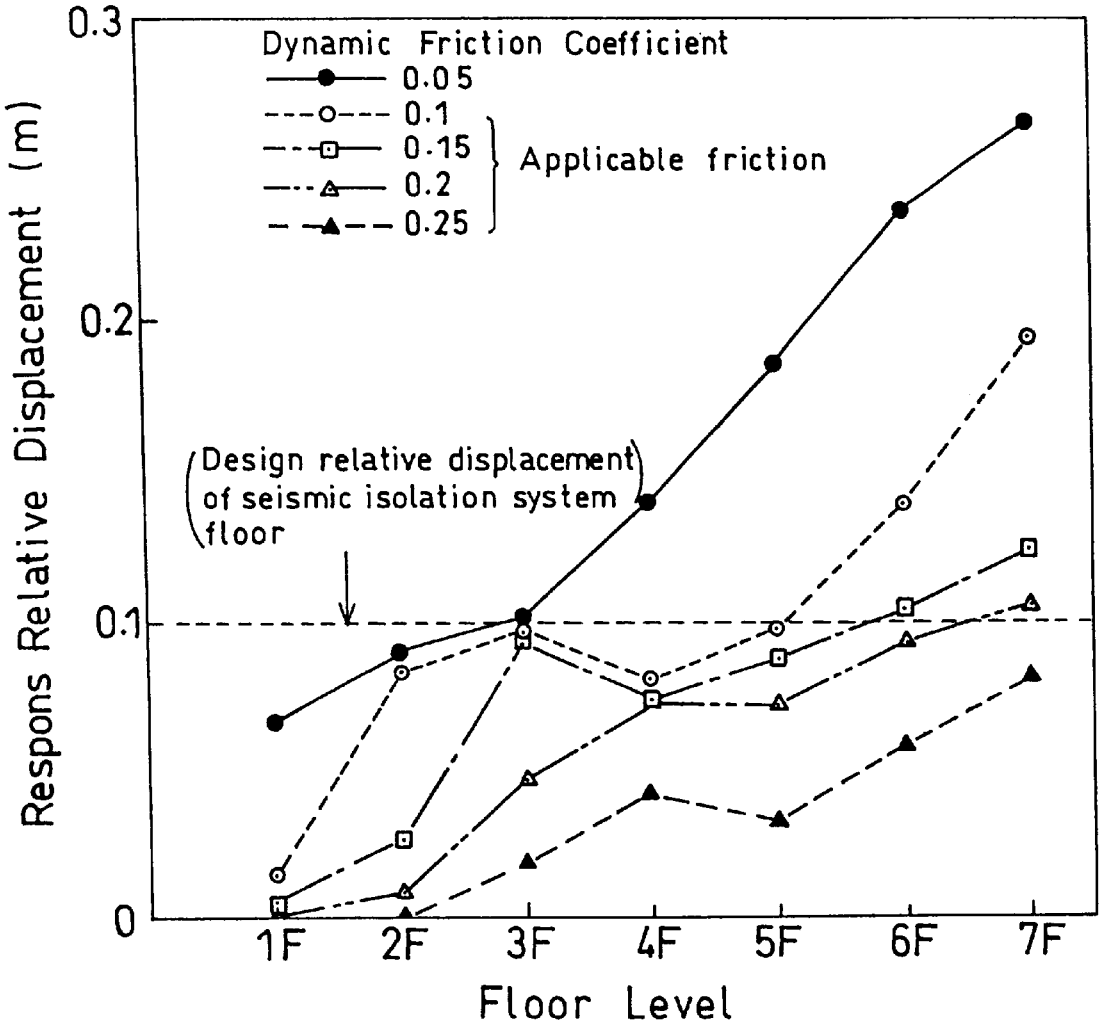
FIG. 10 is a graph showing the analytical results of the seismic isolation effects under various friction conditions when a floor system, according to the present invention, is installed in a building having a plurality of floors.
Figure 11:
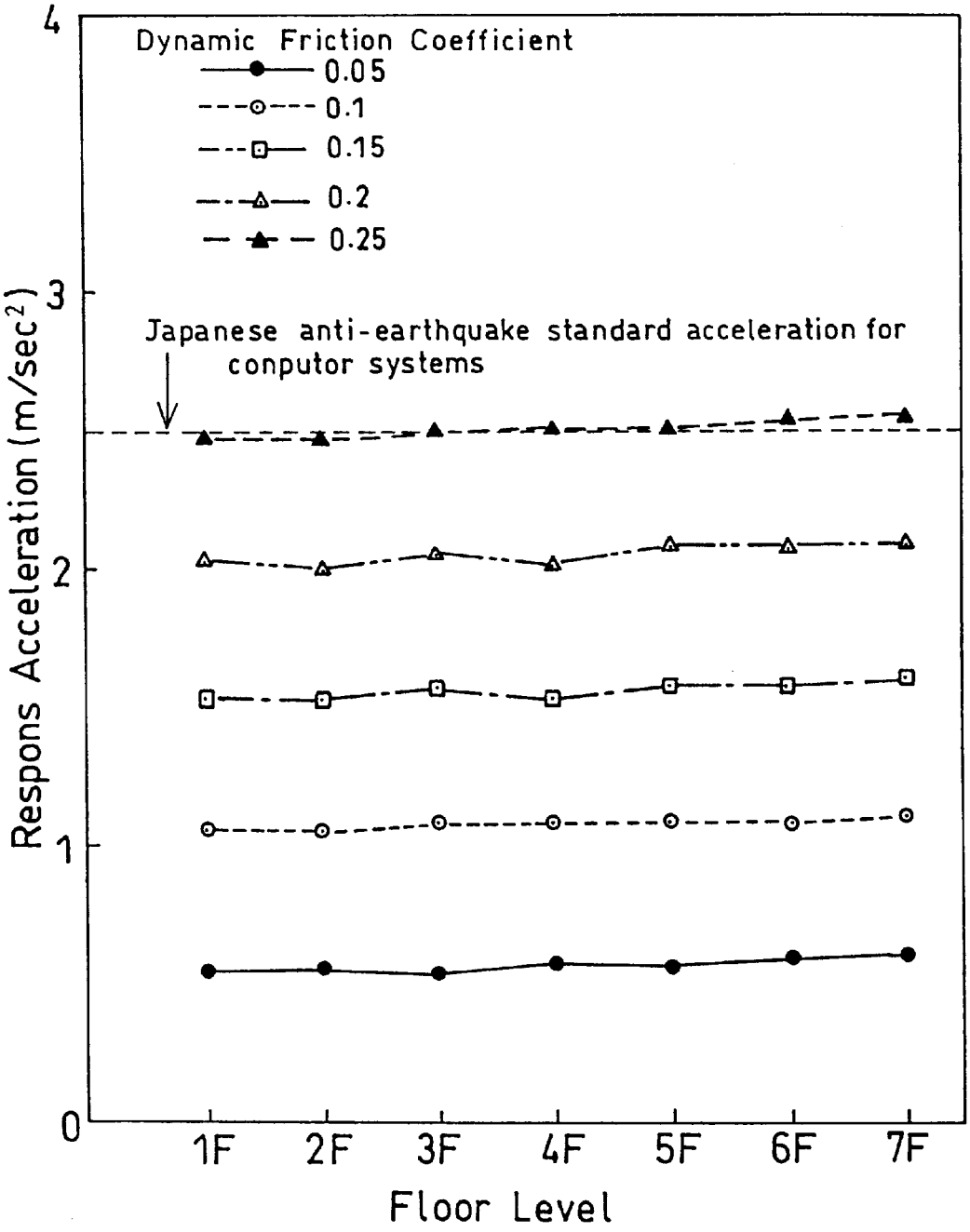
FIG. 11 is also a graph showing the analytical results of another seismic isolation effect under various friction conditions when the floor system, according to the present invention, is installed in the building having a plurality of floors.

FIGS. 10 and 11 are graphs showing the analytical results using the El Centro earthquake waveform having a maximum speed of 2.5 $m/s^2$, wherein the horizontal axis indicates floors of the building and the vertical axis indicates the maximum displacement and maximum acceleration of the floor system on each floor using the dynamic coefficient of friction as a parameter.

In FIG. 10, when the dynamic coefficient of friction is 0.05, the maximum displacement of the floor system on the third floor is 10 cm which is within the design range of ±10 cm for the floor system according to the present invention. However, on the floors higher than the third floor, the maximum displacement is greatly beyond the design range. When the dynamic coefficient of friction is 0.1 or more on the sixth floor and on the higher floors, the maximum displacement is more than the design range, although it can be understood that the maximum displacement is applicable as a whole.

In FIG. 11, when the dynamic coefficient of friction increases, the response acceleration of the floor system increases. When the dynamic coefficient of friction reaches 0.25, the response acceleration of the floor system reaches 2.5 $m/s^2$, which is an allowable acceleration, decided as an anti-earthquake reference of a computer in Japan. Therefore, it can be understood that a dynamic coefficient of friction of 0.25 or more is desirable. Even when another is used, it is ascertained that almost the same result can be obtained if the maximum acceleration of the earthquake waveform is 2.5 $m/s^2$.

As mentioned above, the simulation result shows that a value of the dynamic coefficient of friction within the range from 0.09 to 0.25 is a most effective value.

Figure 12:
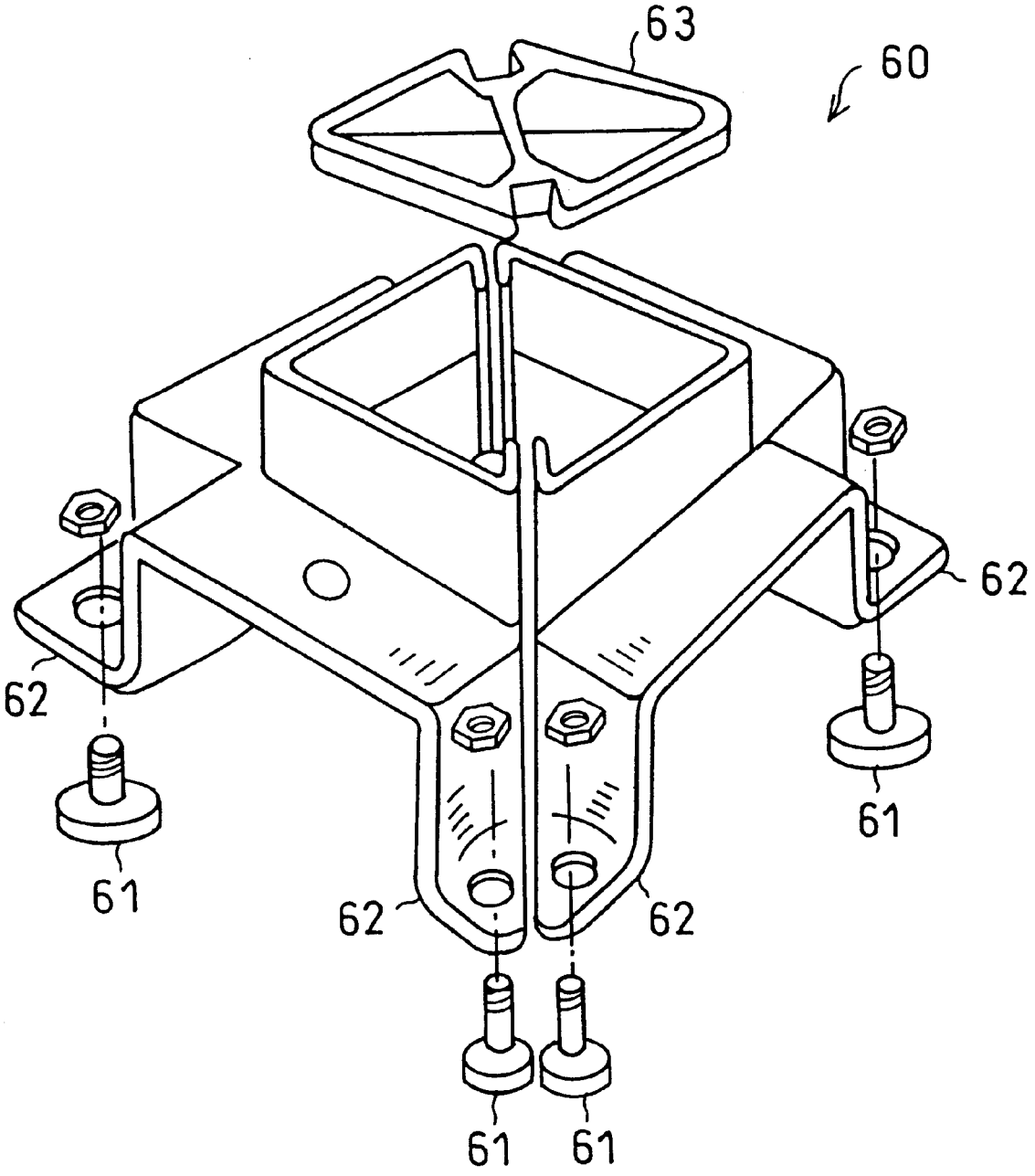
FIG. 12 is a perspective view showing another embodiment of the support used in the floor system according to the present invention.

Next, FIG. 12 is a perspective view showing another embodiment of the supports used in the present invention. A support 60 has a shape that is obtained by cutting the support 12, shown in FIG. 2, in half in the direction of the diagonal line. Namely, the support 60 has three support legs 61 and three support bottoms 62. When two supports 60 are united, the same structure as that of the support 12, shown in FIG. 2, is formed. In the embodiment, a combination ring 63 is fit onto the top of the supports 60 to prevent the two supports 60 from being separated. A cover (equivalent to 23 shown in FIG. 2) is provided on the ring 63.

Figure 13:
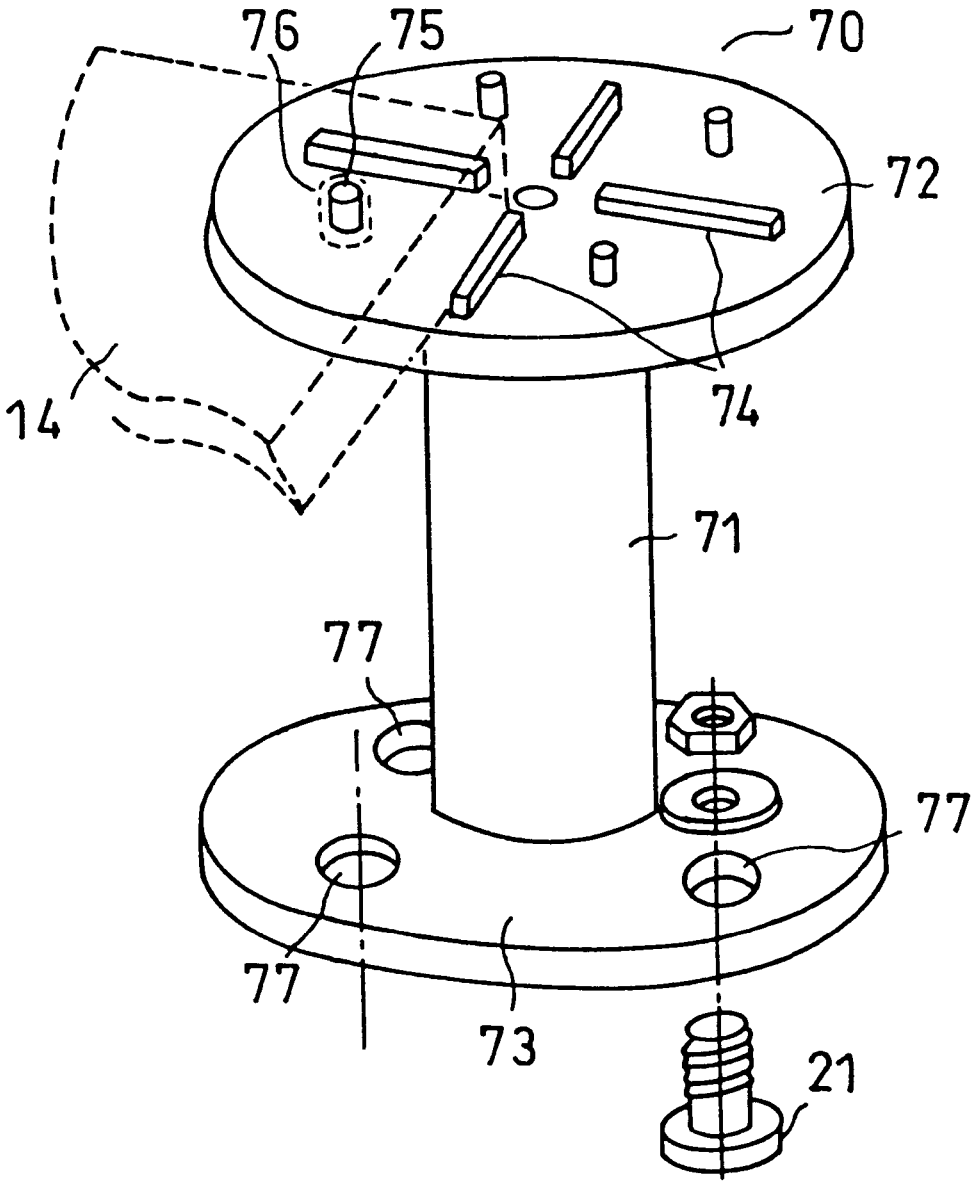
FIG. 13 is a perspective view showing still another embodiment of the support used in the floor system according to the present invention.

FIG. 13 is a perspective view showing still another embodiment of the supports applied to the present invention. A support 70 has a cylindrical body 71 at the upper end and lower end. Disks 72 and 73, having an area larger than the horizontal section of the body 71, are fixed horizontally to the upper and lower ends of the cylindrical body 71 of the support 70. On the top of the upper disk 72, four strip-shaped projections 74 extend in the radial direction from the center of the disk 72 and are positioned so as to be on orthogonally intersecting lines. On the top of the disk 72, between two adjacent strip-shaped projections 74, a cylindrical projection 75 is attached. Between two adjacent strip-shaped projections 74, as shown by a dashed line, the corner of the panel 14 is mounted and the cylindrical projection 75 is fit into a fixing hole 76 bored in the panel 14 to fix the panel 14 so as to prevent horizontal movement thereof. On the other hand, in the lower disk 73 of the support 70, a plurality of holes 77 are bored and the support legs 21, shown in FIG. 4 or 5, are attached via the support legs 21 being placed through the holes 77 and having nuts attached to the threads at the top of the support legs 21. These supports 70, as shown in FIG. 1, may then be mounted on the sliding plates 11 provided on the base floor. Using this type of support 70, according to the present invention, a conventional type floor system can be easily refashioned into a seismic isolation type floor system.

Next, an embodiment when the floor system, according to the present invention, is provided on each floor of a building having many floors will be explained.

Although the coefficient of friction for the floor systems is selected as one of the values within the range of from 0.09 to 0.25 when the present invention is applied to a building having many stories, a different coefficient of friction is selected depending on what level of the building the floor is at.

Namely, as mentioned previously, the maximum relative displacement of the floor system, when an earthquake occurs, is small on the lower floor levels of the building and as the floor level increases, the maximum relative displacement increases. On the other hand, when the dynamic coefficient of friction between the supports of the floor system and the sliding plates is a small value, the sliding displacement is large and when the dynamic coefficient of friction between the supports of the floor system and the sliding plates is a large value, the sliding displacement is small. Therefore, on the lower floor levels of the building, a value close to 0.09 is applied. On the middle floor levels of the building, a coefficient of friction of almost a medium value, between 0.09 and 0.25, is used. On the upper floor levels, a comparatively large coefficient of friction close to 0.25 is used so as to decrease the sliding distance.

As already explained, the seismic isolation effect of the floor system according to the present invention can be produced more surely by using different materials having a different coefficient of friction on the support side. For example, polytetrafluoroethylene is used as a material having a comparatively small coefficient of friction. A plastic being made of some polytetrafluoroethylene and carbon is used as a material having a medium coefficient of friction. Brass is used as a material having a high coefficient of friction.

The embodiments of the present invention are explained above in detail, but the present invention is not limited to the aforementioned embodiments and various modifications are available. For example, according to the aforementioned embodiments, the support legs 21 are fixed to the bottoms 22 of the supports 20 or the bottoms of the supports 70. However, as a material for the supports themselves, when a material having a dynamic coefficient of friction within the range of from 0.09 to 0.25 is used between the supports and the sliding plates 11 or the sliding surfaces, the support legs 21 can be omitted. In this case, when the friction member 50, made of a material having a dynamic coefficient of friction within the range of 0.09 to 0.25 is adhered to the support bottoms, the supports 20 and 70 having a necessary dynamic coefficient of friction can be obtained, unless a material having a special dynamic coefficient of friction is used for the supports themselves. When the rubber pad 30, shown in FIG. 3, is directly adhered to the bottom 22 of each support 20, without using the support leg 21, and polytetrafluoroethylene solid lubricant or plastic made up of some polytetrafluoroethylene is coated on the bottom of the rubber pad 30 so as to be sheet-shaped or integratedly formed, a support leg having a simple structure can be obtained.

Therefore, in the explanation of the present invention, the "support leg" means a member which is additionally fixed to the bottom of the support so as to adjust the dynamic coefficient of friction between the support leg and the sliding plate and is not always limited to the structure shown in FIG. 4 or 5.

The materials constituting the sliding plates 11 and the support legs 21 can be mutually exchanged. Namely, according to the present invention, the dynamic coefficient of friction between the two may be within the aforementioned predetermined range, so that it is possible to make the support legs 21 using the material for the sliding plates 11 explained in the aforementioned embodiments and to make the sliding plates 11 using the material for the support legs 21 explained in the above embodiments.

According to the present invention, with a simple structure and at a low cost, a floor system having a seismic isolation structure can be realized. Namely, the floor system according to the present invention absorbs the shock by allowing the entire floor system to properly slide and displace its position for the vibration due to the occurrence of an earthquake. As a result, it is possible to prevent the panels, forming the floor surface, from colliding with each other, being pushed up, and being destroyed. Equipment, such as office desks, document cases, and electronic information processing devices, installed on the floor, can be prevented from falling down and being damaged.

With the seismic isolation floor structure according to the present invention, which can be constructed easily at a low cost, the system is applied with high satisfaction not only to a new construction but also to refashion a previously non-anti-earthquake floor system. Furthermore, even in a comparatively high building, a seismic isolation floor can be realized by simply changing the value of dynamic coefficient of friction depending on the floor level on which the floor system is provided.

What is claimed is:

1. A floor system of a seismic isolation type forming a space for laying cables between a bottom of a floor surface created by said floor system and a top of a base floor, the floor system comprising:

a sliding surface formed at least at a part of the base floor;

a plurality of supports arranged on said sliding surface so as to freely slide, without restriction, to provide said floor system with a seismic isolation function; and a plurality of panels which are mutually connected to each other by fixing ends thereof to said plurality of supports to form said floor surface, wherein said space in which the cables are laid is located between bottoms of said plurality of panels and said sliding surface formed on the base floor, and wherein a coefficient of friction between said bottoms of said plurality of supports and said sliding surface is within a range of from 0.09 to 0.25.

2. The floor system according to claim 1, wherein said sliding surface comprises any one of a group consisting of a non-ferrous metal, a stainless steel sheet, a hard plated steel sheet, a plastic coated plate having a coating made of some polytetrafluoroethylene, and a plastic plate made of some of the polytetrafluoroethylene.

3. The floor system according to claim 1, wherein said bottoms of said plurality of supports are made from any one of a group consisting of plastics, brass, iron, and hard plated iron.

4. The floor system according to claim 1, wherein said bottoms of said plurality of supports are attached to support legs, said support legs having bottom surfaces which are in contact with said sliding surface, and said bottom surfaces of said support legs being made from any one of a group consisting of plastics, brass, iron, and hard plated iron.

5. The floor system according to claim 3 or claim 4, wherein said hard plated iron is plated with chromium.

6. The floor system according to claim 4, wherein said plastics are any one of a group consisting of plastic made entirely of polytetrafluoroethylene, plastic made of some of the polytetrafluoroethylene, plastic made of some oil and carbon, and plastic made of some solid lubricant.

7. The floor system according to claim 1, wherein said sliding surface has an area in which said plurality of supports are displaceable at least a distance of ±10 cm or more.

8. The floor system according to claim 1, wherein at least some portion of each of the cables, laid in said space between said bottoms of said plurality of panels and the top of the base floor, comes into contact with said sliding surface, said at least some part of the cables being made of a member for reducing a frictional resistance, and said member being made of some polytetrafluoroethylene.

9. The floor system according to claim 8, wherein the cables, laid in said space between said bottoms of said plurality of panels and the top of the base floor, have a slack sufficiently long so as not to restrict a sliding operation of said plurality of supports.

10. The floor system according to claim 1, wherein each panel of said plurality of panels are made of an approximately square plate having corners which are fixed to said plurality of supports.

11. A floor system of seismic isolation type forming a space for laying cables between a bottom of a floor surface of said floor system and a top of a base floor, the floor system comprising:

a plurality of sliding plates arranged on the base floor;

a plurality of supports arranged on sliding surfaces of said sliding plates so as to freely slide, without restriction, to provide said floor system with a seismic isolation function; and a plurality of panels which are mutually connected to each other by being fixed at ends thereof to said plurality of supports to form said floor surface of said floor system, wherein said space in which the cables are laid is located between bottoms said plurality of panels and the top of the base floor.

12. The floor system according to claim 11, wherein said sliding surfaces comprise any one of a group consisting of a non-ferrous metal, a stainless steel sheet, a hard plated steel sheet, a plastic coated plate having a coating made of some polytetrafluoroethylene, and a plastic plate made of some of the polytetrafluoroethylene.

13. The floor system according to claim 11, wherein said bottoms of said plurality of supports are made from any one of a group consisting of plastics, brass, iron, and hard plated iron.

14. The floor system according to claim 11, wherein said bottoms of said plurality of supports are attached to support legs, said support legs having bottom surfaces which are in contact with said sliding surfaces, and said bottom surfaces of said support legs being made from any one of a group consisting of plastics, brass, iron, and hard plated iron.

15. The floor system according to claim 12, wherein said hard plated steel sheet is plated with chrormium.

16. The floor system according to claim 13, wherein said plastics are any one of a group consisting of plastic made entirely of polytetrafluoroethylene, plastic made of some polytetrafluoroethylene, plastic made of some oil and carbon, and plastic made of some solid lubricant.

17. The floor system according to claim 11, wherein said sliding plates have an area in which said plurality of supports are displaceable at least a distance of ±10 cm or more.

18. The floor system according to claim 11, wherein at least some portion of each of the cables, laid in said space between said bottoms of said plurality of panels and the top of the base floor, comes into contact with said sliding surfaces, said at least some part of the cables being made of a member for reducing a frictional resistance, and said member being made of some polytetrafluoroethylene.

19. The floor system according to claim 18, wherein the cables, laid in said space between said bottoms of said plurality of panels and the top of the base floor, have a slack which is long enough not to restrict a sliding operation of said plurality of supports.

20. The floor system according to claim 11, wherein a first of said group consisting of said plurality of sliding plates and bottoms of said plurality of supports is made of any one of a group consisting of a non-ferrous metal, a stainless steel sheet, a hard plated steel sheet, a plastic coated plate having a coating made of some polytetrafluoroethylene, and a plastic plate made of some polytetrafluoroethylene, and wherein a second of said group consisting of said plurality of sliding plates and said bottoms of said plurality of supports is made of any one of a group consisting of plastics, brass, iron, and hard plated iron.

21. The floor system according to claim 20, wherein said plastics are any one of a group consisting of plastic made entirely of polytetrafluoroethylene, plastic made of some of the polytetrafluoroethylene, plastic made of some oil and carbon, and plastic made of some solid lubricant.

22. The floor system according to claim 2, wherein said hard plated steel sheet is plated with chromium.

23. The floor system according to claim 1, wherein a first of a group consisting of said plurality of sliding surfaces and bottoms of said plurality of supports is made of any one of a group consisting of a non-ferrous metal, a stainless steel sheet, a hard plated steel sheet, a plastic coated plate having a coating made of some polytetrafluoroethylene, and a plastic plate made of some polytetrafluoroethylene, and wherein a second of said group consisting of said plurality of sliding surfaces and said bottoms of said plurality of supports is made of any one of a group consisting of plastics, brass, iron, and hard plated iron.

24. A method for constructing a floor system, of seismic isolation type, forming a space for laying cables between a bottom of a floor surface of said floor system and a top of a base floor, said method comprising the steps of:

forming a sliding surface at least at a part of the base floor;

arranging a plurality of supports on said sliding surface, wherein each support of said plurality of supports has a pedestal and a bottom such that said bottoms of said plurality of supports are in contact with said sliding surface so that said bottoms of said plurality of supports slide freely on said sliding surface, without restriction, to provide said floor system with a seismic isolation function; and forming said floor surface by mutually connecting a plurality of panels by fixing ends of said plurality of panels to said pedestals of said plurality of supports, wherein said sliding surface and said bottoms of said plurality of supports are made of materials, a coefficient of friction between which is within a range of from 0.09 to 0.25.

25. A method for constructing a floor system, of seismic isolation type, forming a space for laying cables between a bottom of a floor surface of said floor system and a top of a base floor, said method comprising the steps of:

arranging a plurality of sliding plates on the base floor;

arranging a plurality of supports, each support of said plurality of supports having a pedestal and a bottom, on said sliding plates in a manner that said bottoms of said plurality of supports are in contact with said sliding plates so that said bottoms of said plurality of supports slide freely on said sliding surface, without restriction, to provide said floor system with a seismic isolation function; and forming said floor surface by mutually connecting a plurality of panels by fixing ends of said plurality of panels to said pedestals of said plurality of supports wherein said sliding plates and said bottoms of said plurality of supports are made of materials, a coefficient of friction between which is within a range of from 0.09 to 0.25.

26. A method for constructing a floor system, of seismic isolation type, forming a space for laying cables between a bottom of a floor surface of said floor system and a top of a base floor on each floor of a building having many floors, said method comprising the steps of:

arranging a plurality of sliding plates on the base floor;

arranging a plurality of supports, each support of said plurality of supports having a pedestal and a bottom, on said plurality of sliding plates in a manner that said bottoms of said plurality of supports are in contact with said plurality of sliding plates so that said bottoms of said plurality of supports slide freely on said sliding surface, without restriction, to provide said floor system with a seismic isolation function; and forming said floor surface by mutually connecting a plurality of panels by fixing ends of said plurality of panels to said pedestals of said plurality of supports, wherein said plurality of sliding plates and said bottoms of said plurality of supports are made of a material, a coefficient of friction between which is within a range of from 0.09 to 0.25, and wherein said plurality of sliding plates and said bottoms of said plurality of supports are made of materials having a relatively small coefficient of friction within said range on lower floors and a relatively large coefficient of friction within said range on higher floors.

* * * * *